US005552758A

United States Patent [19]

Tobin

[11] Patent Number: 5,552,758

[45] Date of Patent: Sep. 3, 1996

[54] DARTS SCOREBOARD

[76] Inventor: Robert E. Tobin, 65 Still River Rd., P.O. Box 243, Bolton, Mass. 01740

[21] Appl. No.: 478,430

[22] Filed: Jun. 7, 1995

Related U.S. Application Data

[63] Continuation of Ser. No. 906,684, Jun. 30, 1992, abandoned.

[51] Int. Cl.[6] ..... F41J 3/00

[52] U.S. Cl. ..... 340/323 R; 116/222; 116/321; 273/408; 273/DIG. 26

[58] Field of Search ..... 340/323 R; 116/222, 116/321; 273/148 R, 376, 408, DIG. 26, 379, 386, 387

[56] References Cited

U.S. PATENT DOCUMENTS

| | | | |
|---|---|---|---|
| 2,900,188 | 8/1959 | Lemon | 273/408 |
| 3,059,928 | 10/1962 | Flanagan | 273/408 |
| 3,144,252 | 8/1964 | Saunders | 116/222 |
| 4,003,579 | 1/1977 | Miscavage | 273/148 R |
| 4,105,119 | 8/1978 | Cowan | 273/DIG. 26 |
| 4,567,461 | 1/1986 | Honekman et al. | 340/323 R |
| 4,651,998 | 3/1987 | Holt et al. | 273/DIG. 26 |
| 4,948,148 | 8/1990 | Danielson | 116/222 |
| 5,054,792 | 10/1991 | Danielson | 116/222 |
| 5,114,155 | 5/1992 | Tillery et al. | 273/376 |
| 5,384,561 | 1/1995 | Smith | 340/323 R |

*Primary Examiner*—John K. Peng
*Assistant Examiner*—Edward Lefkowitz
*Attorney, Agent, or Firm*—David G. Conlin; Peter F. Corless

[57] ABSTRACT

A darts scoreboard having a plurality of tracks on a panel. Each track supports a horizontally reciprocal slide bar. The slide bar reciprocates back and forth across an opening to reveal one or more of three indicators. A column of indicia is provided on the panel adjacent to the openings so that each opening corresponds to one of the indicia. A keyboard and display may be mounted on the scoreboard to provide numerical computation capability.

22 Claims, 4 Drawing Sheets

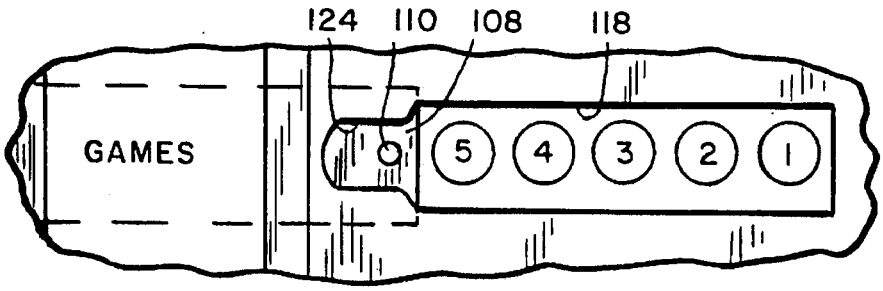
FIG. 2
FIG.3
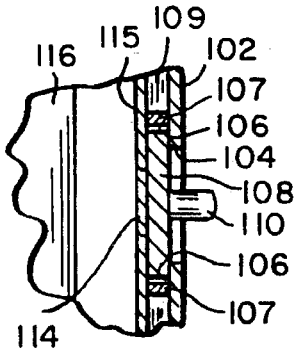
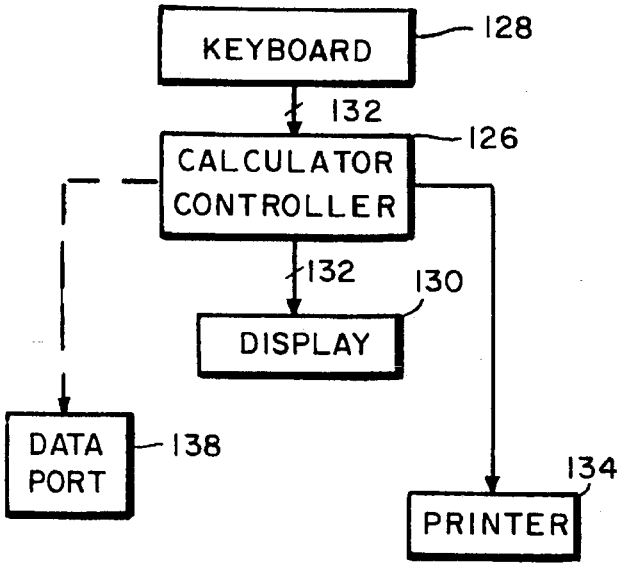
FIG.6

DARTS SCOREBOARD

This is a continuation of application Ser. No. 07/906,684 filed on Jun. 30, 1992, now abandoned.

BACKGROUND OF THE INVENTION

The present invention is directed to a score board for the games of darts, in particular for a game called cricket.

Cricket is a common form of the game of darts. A dart board has a bullseye at its center and is otherwise divided like a pie into 20 sectors numbered from 1 to 20. An outer annular ring scores double within its respective sector. There is also a thin inner ring which scores triple. In order to win a game of cricket, a player must score three of each of the numbers 15, 16, 17, 18, 19 and 20 and three bullseyes. The game may also include scoring points when a player has completed three of a required number before the opponent does. Then additional darts in the completed sector will score points for the player. Thus, in playing cricket it is very helpful for the dart thrower to be aware of which sectors have been completed by the player and the player's opponent.

Conventionally, cricket is scored on a chalkboard or a greaseboard. This board will have a vertical list of the required sectors including 20, 19, 18, 17, 16, 15 and the bullseye. A space is provided next to each of these sectors for slash marks to indicate when a dart has hit within the designated sector. At the completion of the game the marks are erased and a new game can be started. The chalk or markers that are used with these scoreboards can be messy, dirtying up the scorekeeper's hands. The board will also tend to become dirty and less visible over time.

Another popular darts game is 301, 501 or 1001. In this game a player begins with the number 301, 501 or 1001 and as the darts are thrown into the numbered sectors the scores hit by the darts are subtracted from a player's total. The object is to reduce the total to exactly zero.

It is an object of the present invention to provide a darts scoreboard that is clean, reusable and highly visible for use in cricket, 301 or any other numerically scored game.

SUMMARY OF THE INVENTION

The present invention is directed to a darts scoreboard having a plurality of horizontal tracks. On each track is a slide bar. Behind each track are three indicators. As a player in the game of cricket throws darts into a numbered sector between 15 and 20 or the bullseye, a slide bar is moved over an indicator until the player scores all three of the needed hits. When all three have been made the slide bar is closed over the indicators making a clear presentation to the players standing eight feet back from the dart board that a certain sector has been completed. The indicators may be advantageously illuminated to further improve their visibility.

The darts scoreboard of the invention may also include a calculator for computing and monitoring the score. A printer is additionally provided to provide a printout of the score which may possibly be used as official verification of a perfect game for instance.

It has been found that the darts scoreboard of the present invention enhances interest in the games of darts. Bystanders may show an interest in keeping score with the scoreboard of the invention whereas the use of chalkboards or greaseboards tend to be less appealing. Since the scoreboards are generally mounted adjacent the darts board, the present invention has been further applauded by players who find the visual presentation of the state of the match to be far improved over the conventional scoreboards.

Other objects and advantages of the invention will become apparent during the following description of the presently preferred embodiments of the invention taken in conjunction with the drawings.

BRIEF DESCRIPTION OF THE DRAWINGS

FIG. 2 is an enlargement of the "games won" section of the darts scoreboard of FIG. 1.

FIG. 3 is a partial cross-sectional view of the darts scoreboard of FIG. 1.

FIG. 6 is a schematic block diagram of the calculator electronics of the darts scoreboard of FIG. 4.

DETAILED DESCRIPTION OF THE PREFERRED EMBODIMENTS

Figure 1:
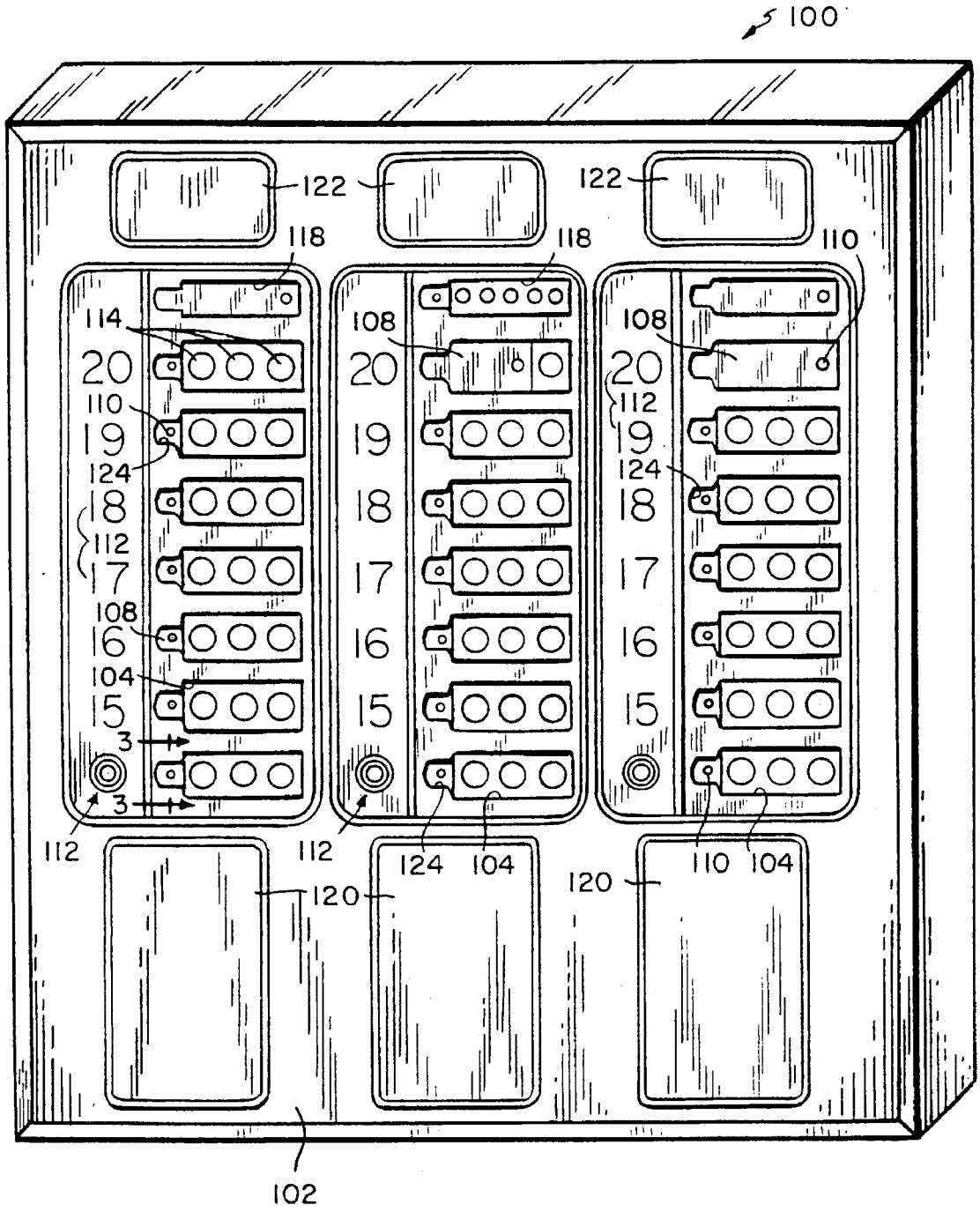
FIG. 1 is an isometric view of a first embodiment of the darts scoreboard of the present invention.

Referring now to FIG. 1, a simplified version of the darts scoreboard 100 of the present invention is illustrated. The scoreboard is a panel 102 which includes for each player, seven vertically aligned horizontal openings 104. Each opening 104 is provided with a track 106 on which a sliding bar 108 reciprocally moves. Each sliding bar 108 may be provided with a handle 110 for ease of operation. A vertical column of indicia 112 is located on the panel 102 adjacent the horizontal openings 104. Each of the horizontal openings 104 is associated with one of the indicia 112 in the column. The indicia include the numbers 20, 19, 18, 17, 16, 15 and bullseye, those being the sectors which must be hit to win a game of cricket. Behind each opening 104 in the panel 102 are a series of three indicators 114 horizontally aligned across the opening. Each indicator 114 may preferably be a frosted window with the corresponding indicia imprinted thereon. A light source 116 may be mounted behind the window indicators 114 to illuminate them, making them more visible to the players.

An additional opening 118 may be provided in the panel 102 to provide an indication of the number of games won by each player. A games won opening is more clearly illustrated in FIG. 2. The sliding bar 108 for use in the games won track would initially be closed and is successively opened to reveal the indicators numbered one to five.

The scoreboard panel 102 may be further provided with greaseboard or chalkboard areas 120 mounted on the panel vertically aligned with a plurality of aligned openings 104. Additional greaseboards 122 at the top of the panel may be used to write in a player's name. The greaseboards 120 at the bottom may be used for calculating the points that can be earned in the game of cricket or to compute and keep track of the score in a game of 301 or the like.

Figure 4:
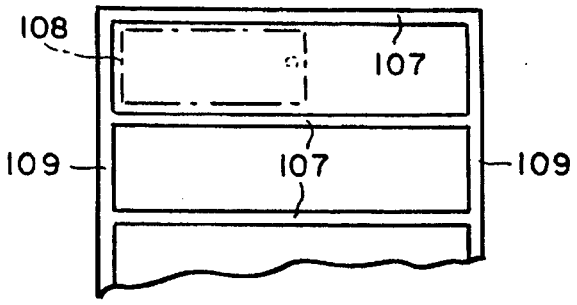
FIG. 4 is a front view of a support grid for the sliding bars of the scoreboard of the invention.
Figure 5B:
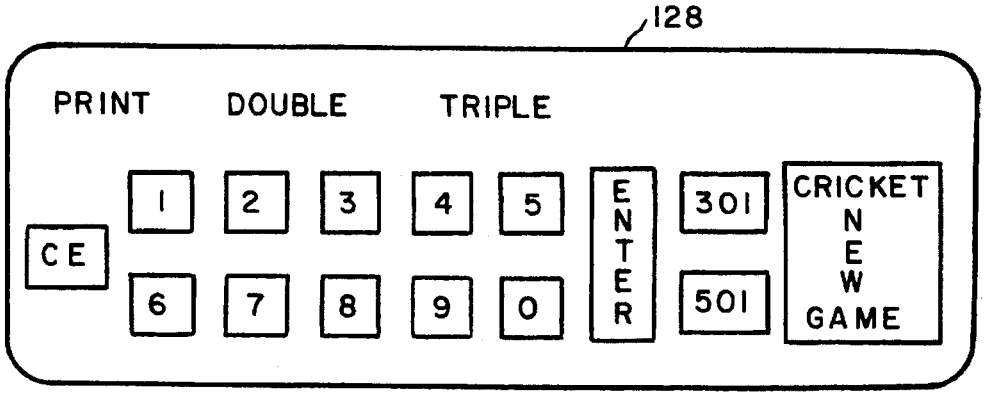
FIG. 5*b* is a front view of the keyboard of the scoreboard of FIG. 5*a*.
Figure 5C:
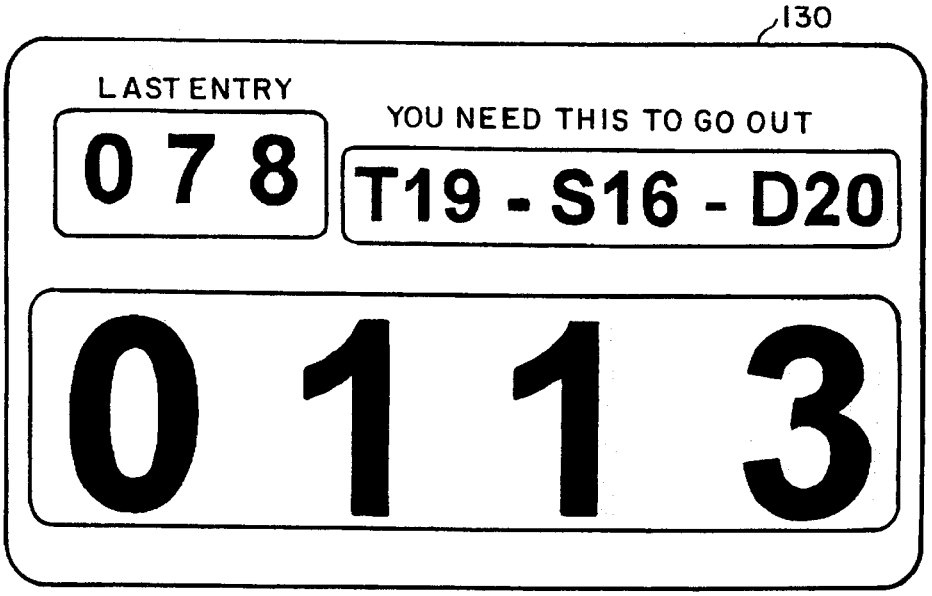
FIG. 5*c* is a front view of the display of the scoreboard of FIG. 5*a*.
Figures 5A, 7:
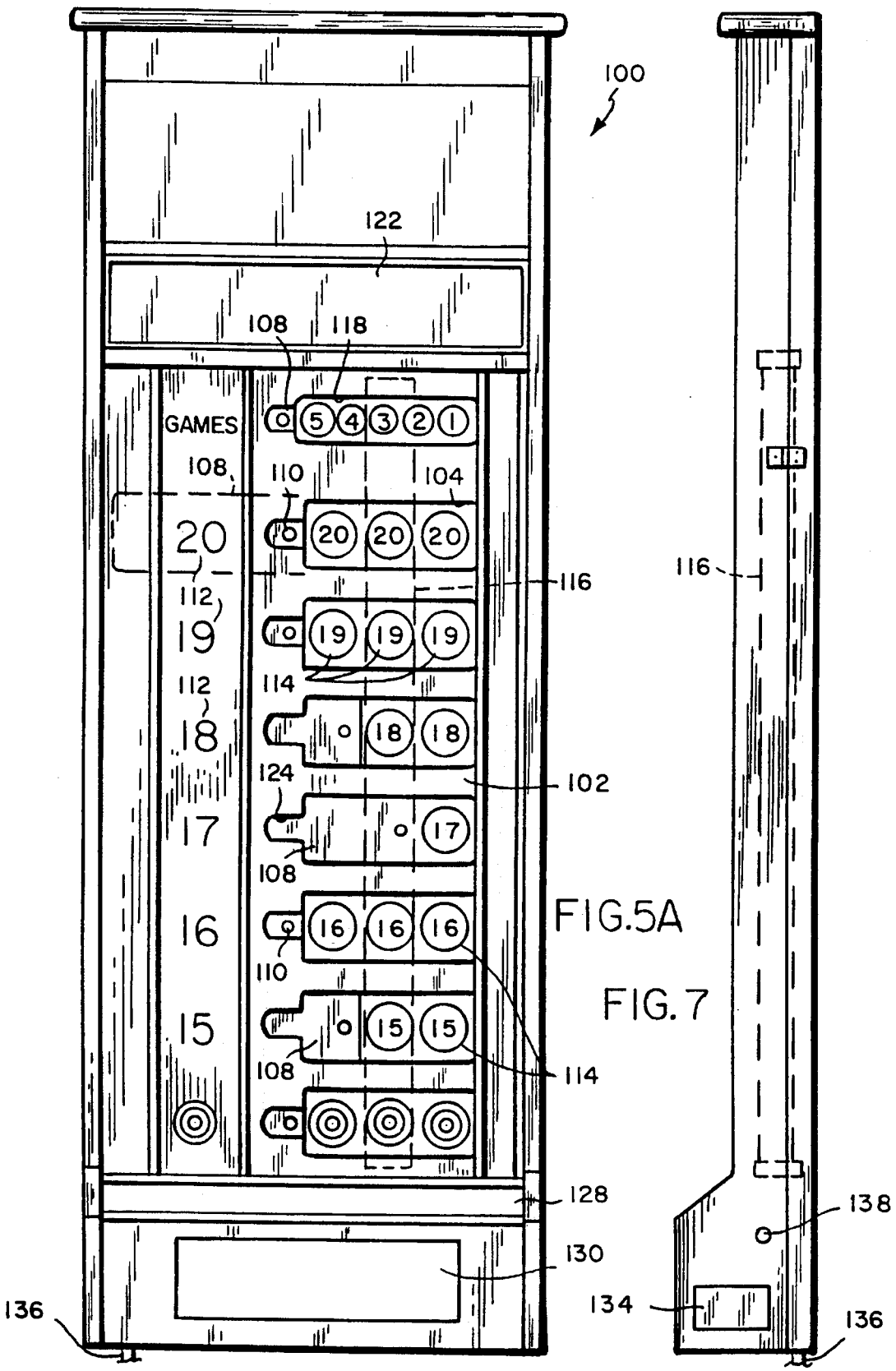
FIG. 5*a* is a front view of a second embodiment of the darts scoreboard of the present invention.
FIG. 7 is a side view of the darts scoreboard of FIG. 4.

Referring now to FIGS. 3 and 4, the tracks 106 used in the present invention are formed by a horizontal groove at the bottom and top of each opening. The groove may be formed by horizontal beams 107 mounted below and above each opening 104 and behind the front panel 102. Vertical beams 109 may also be included to act as stops between which sliding bar 108 may move. A grid of horizontal beams 107 and vertical beams 109 as shown in FIG. 4 may be mounted behind the front panel to facilitate manufacture of the scoreboard. The sliding bar 108 in the groove can move horizontally from a closed position in which all of the indicators 114 in the opening are concealed to an open position in which all of the indicators are visible. The indicators 114 may be formed on a silk screened plastic panel 115 which gets mounted behind the grid of horizontal and vertical beams. The plastic panel would be left clear or translucent in the indicator areas except for the indicia marking. Around the indicators, the panel would be made opaque, preferably black.

In the open position, the sliding bar extends behind the panel. To more completely hide the sliding bar behind the panel in the open position a slot 124 is formed at the end of the horizontal opening into which the handle 110 on the sliding bar inserts when open. It may be further desirable to provide a mechanism for clicking a sliding bar into place as it closes each of the three indicators. This may be accomplished for example, by including a bump on the bottom edge of the sliding bar which engages an indentation in the bottom horizontal beam. The indentations would be provided in each track, one for each indicator.

An additional feature of the present invention is shown in the embodiment of FIGS. *5a, 5b* and *5c*. A calculator may be included on the darts scoreboard. The calculator is shown in a basic block schematic in FIG. 6. A conventional calculator controller 126 programmed for use in conjunction with a specially laid out keyboard 128 and display 130 suitable for the darts scoreboard. In the presently preferred embodiment, connections between the keyboard 128, the controller 126 and the display 130 are made through a six inch ribbon cable 132. However, it would also be possible to provide an electronic wireless communication between a portable handheld keyboard and the controller. The keyboard provides a pad for each of the ten arabic digits. A clear entry (CE) key may be provided to clear the memory when an incorrect button is pressed prior to entering. The enter (E) key is used after the correct numbers corresponding to the score of the darts that hit the dart board have been pressed. A double or triple key permits the calculator to do the calculation when a dart hits within the double or triple ring. A new game key can store the current game scores, clear the calculator current memory for use in a new game and set the calculator program for the game of cricket or any other game in which scores are added. A 301 or 501 key sets the calculator total according to the pressed key and sets the calculator program for the game of 301 or 501 in which scores are successively subtracted.

A display 130 is provided using any conventional technology such as light emitting diodes or liquid crystal. The numbers should be large so that they may be easily read by the players from the throwing line. The presently preferred numerical display presents numbers in the score field that are one inch wide by 2 and a half inches wide. Smaller numerical displays are given to show the last entry made and a presentation of a score combination that gets a player's score to exactly zero for winning a game of 301 or 501. A lookup table may be stored in the calculator for producing an appropriate "to go out" combination for any given score.

The present invention may be further provided with a printer 134. A conventional thermal printer 134 may be used in electronic communication with the calculator controller. A print key would then be provided on the keyboard so that the printer could be instructed to print out a record of the scores that were entered during the game. Another feature that can be included is a data port 138. This would permit the score to be transmitted to a larger projection display scoreboard in a large tournament, for example.

To make the scoreboard of the presently preferred embodiment adequately visible to the players, the numerical indicia 112 on the panel are made one inch in height. The three indicators 114 provided in each opening behind the sliding doors corresponding to the indicia are one inch circles and within each circle is printed arabic numerals that are one half inch in height. These indicators are illuminated in the presently preferred embodiment by a single flourescent light bulb 116 that extends in length from top to bottom behind the panel. The scoreboard panel is mounted to a hinged cabinet door so that the cabinet can be opened for installing and servicing the light bulb. A twenty watt flourescent bulb has been found to be sufficient. Three such bulbs would be used in the embodiment of FIG. 1. An electrical cord 136 extends from the scoreboard for providing electric power to the light. A transformer may be included for reducing the power received through the cord 138 to approximately one ampere for powering the calculator.

In using the darts scoreboard of the present invention to play a game of cricket, all of the sliding bars adjacent the numerical indicia and the bullseye begin in the open position. As a player hits the various indicia on the dart board with his darts, the sliding bars are manually moved progressively over the indicators until the player hits three of the given indicia at which point the sliding bar is pulled all the way over into the closed position. A player wins by closing the sliding bars for all the indicia and the bullseye. If a player completes and closes out an indicia before the opponent, subsequent hits to that indicia may be used to provide a score. The score can be added by the calculator to a player's total displayed on the display. The scoreboard of the present invention is thus clean, visible and easy to use.

Of course, it should be understood that various changes and modifications can be made without departing from the spirit and scope of the invention and without diminishing its attendant advantages. For example, the scoreboard may be provided for one, two or more players. The keyboard and display on the scoreboard may be arranged in any convenient manner to provide a numerical scoring capability. A single calculator may be used to monitor and store the score of more than one player. It is therefore intended that these changes and modifications be covered by the following claims.

I claim:

1. A darts scoreboard suitable for use with a darts game comprising:

a plurality of tracks;

three indicators positioned along each of each said tracks; and a slide bar sitting in each of said tracks and movable along the track to progressively extend over one or more of said three indicators, the slide bar capable of keeping score of the darts game by movement of the bar along the track.

2. The darts scoreboard of claim 1 further comprising indicia adjacent to each of said tracks, each of said indicia independently comprising a bullseye or a number selected from the group consisting of 20, 19, 18, 17, 16, and 15.

3. The darts scoreboard of claim 1 further comprising a track having a series of consecutively number indicators and a slide bar in said track for progressively extending over one or more of said consecutively numbered indicators to display the number of games won.

4. The darts scoreboard of claim 1 further comprising a chalkboard.

5. The darts scoreboard of claim 1 further comprising a greaseboard.

6. The darts scoreboard of claim 1 further comprising a numerical programmable display and a keyboard for operating said display.

7. The darts scoreboard of claim 6 further comprising a printer operated by said keyboard.

8. The darts scoreboard of claim 1 further comprising means for illuminating said indicators.

9. A darts scoreboard suitable for use with a darts game comprising:

a panel;

a plurality of horizontal tracks vertically aligned on said panel;

three indicators horizontally aligned along each of said tracks; and a slide bar sitting in each of said tracks and reciprocally movable horizontally along the track to progressively extend over one or more of said three indicators, the slide bar capable of keeping score of the darts game by movement of the bar along the track.

10. The darts scoreboard of claim 9 further comprising a light source behind said panel for illuminating said indicators to make the indicators that are not covered by their respective slide bar clearly visible.

11. The darts scoreboard of claim 9 further comprising a programmable display mounted adjacent to said panel, a calculator controller for controlling said display and a keyboard in communication with said calculator controller.

12. The darts scoreboard of claim 11 further comprising a printer in electronic communication with said calculator controller.

13. The darts scoreboard of claim 9 wherein said plurality of tracks comprises seven tracks and further comprising a vertical column of seven indicia, each indicia being adjacent one of said seven tracks, said seven indicia including in sequence 20, 19, 18, 17, 16, 15 and a bullseye.

14. The darts scoreboard of claim 9 further comprising a track having a series of consecutively number indicators and a slide bar in said track for progressively extending over one or more of said consecutively numbered indicators to display the number of games won.

15. The darts scoreboard of claim 9 further comprising a chalkboard attached to said panel.

16. The darts scoreboard of claim 9 further comprising a greaseboard attached to said panel.

17. A darts scoreboard suitable for use with a darts game comprising:

a front panel;

a plurality of horizontal openings in said panel vertically aligned on said front panel;

an indicator panel supported behind said front panel and having three indicator windows horizontally spaced across each of said openings;

a horizontal track adjacent each of said horizontal openings; and a slide bar sitting in each of said horizontal tracks and reciprocally movable horizontally along the track from a position substantially behind said panel in which the three indicator windows behind the opening adjacent the track are visible from in front of said panel to positions along said track which progressively cover said three indicator windows, the slide bat capable of keeping score of the darts game by movement of the bar along the track.

18. The darts scoreboard of claim 17 further comprising a fluorescent light source housed behind said indicator panel for illuminating said indicator windows to make the indicator windows that are not covered by their respective slide bar clearly visible from in front of said panel.

19. The darts scoreboard of claim 17 further comprising a programmable display mounted adjacent to said panel, a calculator controller for controlling said display and a keyboard in communication with said calculator controller.

20. The darts scoreboard of claim 17 wherein said plurality of openings comprises seven openings and further comprising a vertical column of seven indicia, each indicia being located on said panel adjacent one of said seven openings, said seven indicia including in sequence 20, 19, 18, 17, 16, 15 and a bullseye.

21. A method for maintaining the score of a darts game, comprising:

(a) providing a darts board and a darts scoreboard, the scoreboard comprising a plurality of tracks, three indicators positioned along each of said tracks, and a slide bar sitting in each of said tracks and manually movable along the track to progressively extend over one or more of said three indicators;

(b) manually moving one of said slide bar along the track to extend over one or more of said indicators to keep score of the darts game.

22. A darts game, comprising:

a darts board and a darts scoreboard, the scoreboard comprising a plurality of tracks, three indicators positioned along each of said tracks, and a slide bar sitting in each of said tracks and movable along the track to progressively extend over one or more of said three indicators, the slide bar capable of keeping score of the darts game by movement of the bar along the track.

* * * * *